US005983686A

United States Patent [19]

Lee

[11] Patent Number: 5,983,686

[45] Date of Patent: Nov. 16, 1999

[54] BELT ATTACHMENT AND KEY RING/KEY HOLDER

[76] Inventor: Geon W. Lee, 943 Magnolia Ave., L.A., Calif. 90006

[21] Appl. No.: 08/675,492

[22] Filed: Jul. 3, 1996

[51] Int. Cl.[6] ..... A44B 15/00

[52] U.S. Cl. ..... 70/456 R; 224/269; 224/667; 24/3.11; 24/3.6; 70/459

[58] Field of Search ..... 70/456 R, 459; 24/3.6, 3.11, 3.12, 601.6, 601.5; 224/269, 666, 667

[56] References Cited

U.S. PATENT DOCUMENTS

| | | | |
|---|---|---|---|
| 267,112 | 11/1882 | Sanderson | 70/459 |
| 806,632 | 12/1905 | Breer | 24/3.11 |
| 926,401 | 6/1909 | Freedman | 24/3.11 |
| 1,212,511 | 1/1917 | Kropp | 24/3.6 |
| 1,302,067 | 4/1919 | Mendelsohn | 24/3.6 |
| 1,304,403 | 5/1919 | Storch et al. | 24/3.12 |
| 1,419,408 | 6/1922 | Polhemus | 24/3.12 |
| 1,484,508 | 2/1924 | Lasserre | 24/3.6 |
| 1,724,003 | 8/1929 | Chamberlain | 70/459 |
| 1,848,032 | 3/1932 | Tessier | 24/3.7 |
| 4,113,156 | 9/1978 | Brito | 224/269 |
| 4,391,113 | 7/1983 | Jorgens | 70/459 |
| 4,821,543 | 4/1989 | Scungio | 70/456 R |
| 4,828,153 | 5/1989 | Guzik et al. | 224/269 |
| 5,279,021 | 1/1994 | Edgin | 24/3.6 |
| 5,446,947 | 9/1995 | Lee | 70/456 R |

FOREIGN PATENT DOCUMENTS

| | | | |
|---|---|---|---|
| 502743 | 5/1954 | Canada | 24/3.6 |
| 2500729 | 9/1982 | France | 224/269 |
| 2817677 | 10/1979 | Germany | 70/456 R |
| 0015604 | of 1902 | United Kingdom | 24/601.5 |

*Primary Examiner*—Darnell M. Boucher

[57] ABSTRACT

A key holder and belt attachment device having a body with two legs and a push button in the second leg of the body. The push button is mounted and slidable within the second leg to abut a swinging catch member which allows removal of the belt from a U-shaped slot created by the legs of the body. The swinging catch member is pivotally attached to the second leg and may be biased to the closed position where the belt is held within the slot of the body. The spring-biased push button may close off a second opening of the body which retains keys.

20 Claims, 15 Drawing Sheets

Fig. 14A
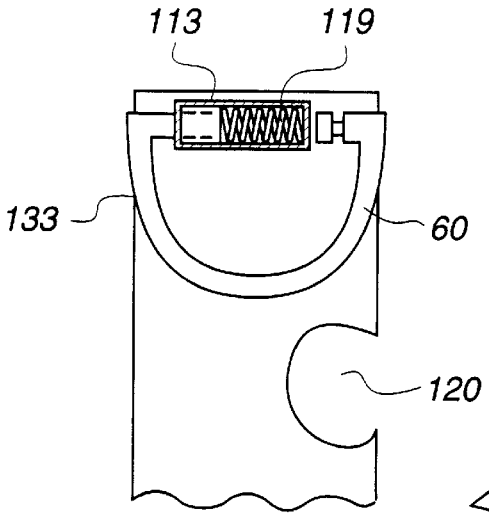
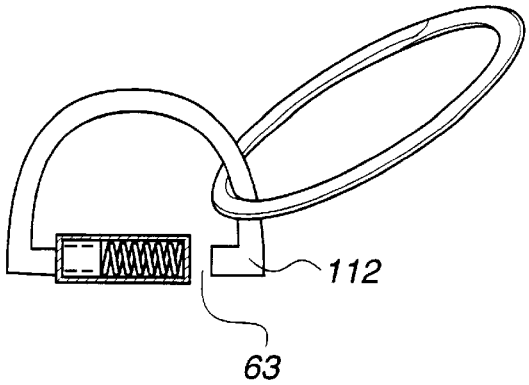
Fig. 14B
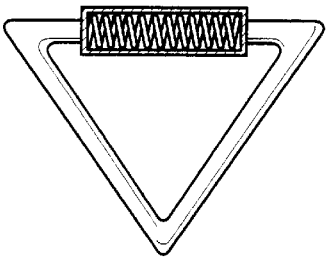
Fig. 15B
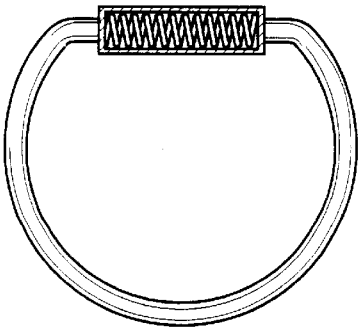
Fig. 15C
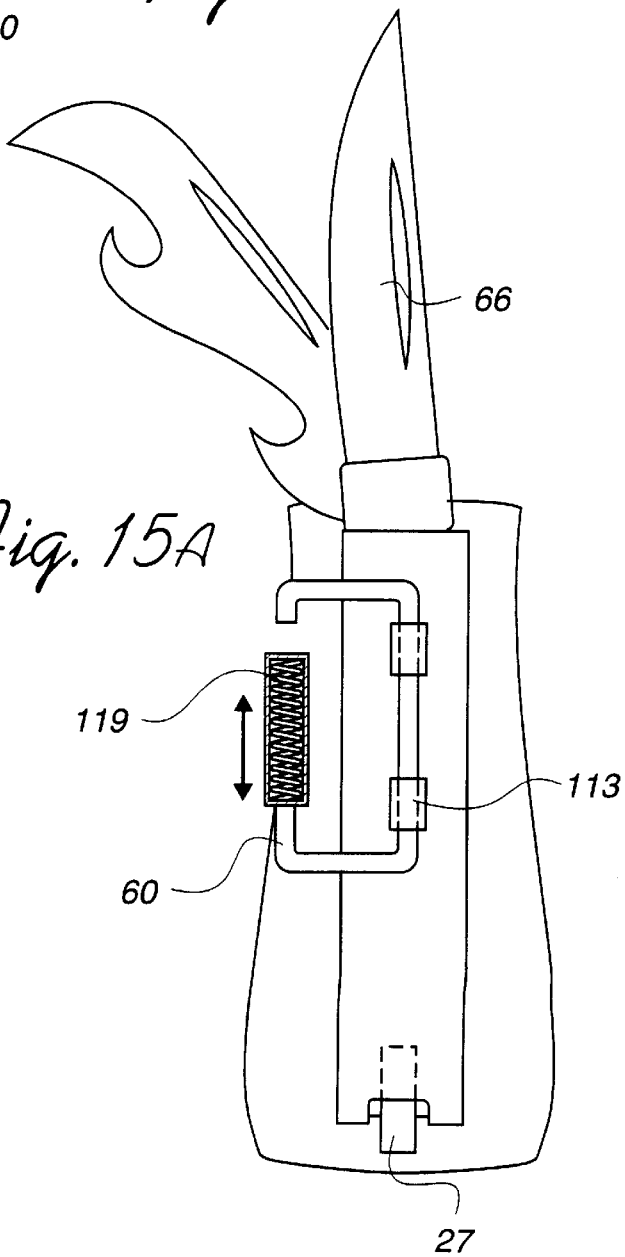
Fig. 15A

BELT ATTACHMENT AND KEY RING/KEY HOLDER

BACKGROUND OF THE INVENTION

1. Field of the Invention

The present invention relates generally to the art of key holders, and specially to a key holder that has a belt attachment which allows the key holder, a pager and other accessiaries to be worn on a belt for convenience.

2. Principal Particulars of the Art

Keys and key rings are common items in everyday life and because of their inherent functionality, people carry their keys with them at all times. Consequently, keys and key rings are often lost or misplaced. The present invention provides a device which prevents one from losing or misplacing his keys by providing a key holder which can be attached to his belt.

Prior art had variations of key rings, key rings with ornamental design, and key rings with varying fastening mechanisms. However, none of the prior art allows a key holder to be fastened to a belt by the unique mechanisms of the present invention.

Accordingly, the principle object of the present invention is to provide a key holder that may be attached to a belt, and to prevent one from losing a key holder without intentional removal.

Another object of the present invention is to provide a key holder with a latch that may be opened and closed to permit the key chain to be conveniently secured on a belt.

Another object of the present invention is to provide a key holder that may also be secured to other various ornaments and accessiaries.

Another object of the present invention is to provide a key holder that is attached to a pager case, and other various articles such as a knife, can opener, hand phone, case for glasses, walkman, etc.

Another object of the present invention is to provide a key rings to accommodate large quantity of keys, and guantity of keys, and to provide easy fastening and releasing.

Yet another object of the present invention is to provide a key holder that is attached to a pen or a pager.

A further object of the present invention is to provide various usage with unique opening mechanisms.

SUMMARY OF THE INVENTION

The present invention is a key holder with a device that can be attached to the belt. The belt attachment device of the key holder comprises a protruding member, a compression spring, and a swivel latch. When the protruding member is pulled, the compression spring is compressed, thereby rotating the swivel latch into an open position. In the open position, the protruding member can be released, causing the swivel latch to rotate into a closed position, thereby securing the key holder in place afterwords.

The present invention also has several variations of key holders, securing mechanisms, and applications. Key holders attached to pager cases, knives, and pens are demonstrated by the present invention as well.

These together with other objects of the invention are explained thoroughly in the claims annexed to and forming a part of this disclosure. For a better understanding of the invention, its use, reference should be made to the accompanying drawings and descriptive matter in which there are illustrated preferred embodiments of the invention.

BRIEF DESCRIPTION OF THE DRAWINGS

For a better understanding of the principle and nature of the present invention, reference should be made to the following detailed description taken in connection with the accompanying drawings in which;

FIG. 14A depicts a variation of a key holder used in conjunction with a can opener.

FIG. 14B depicts a variation of a key holder of 14A without a can opener.

FIG. 15A depicts a variation of the key holder used in conjunction with a pocket knife.

FIG. 15B depicts a variation of the same key ring used in conjunction with the key holder depicted in FIG. 15A.

FIG. 15C depicts a variation of the same key ring used in conjunction with the key holder depicted in FIG. 15A.

DETAILED DESCRIPTION OF THE PREFERRED EMBODIMENT

Figure 1:
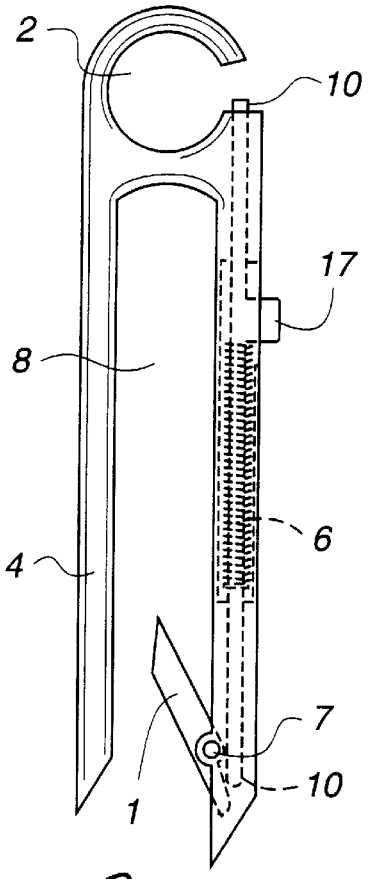
FIG. 1 is a right-side elevational view of the key holder with belt attachment exposing its inner parts.
Figure 1A:
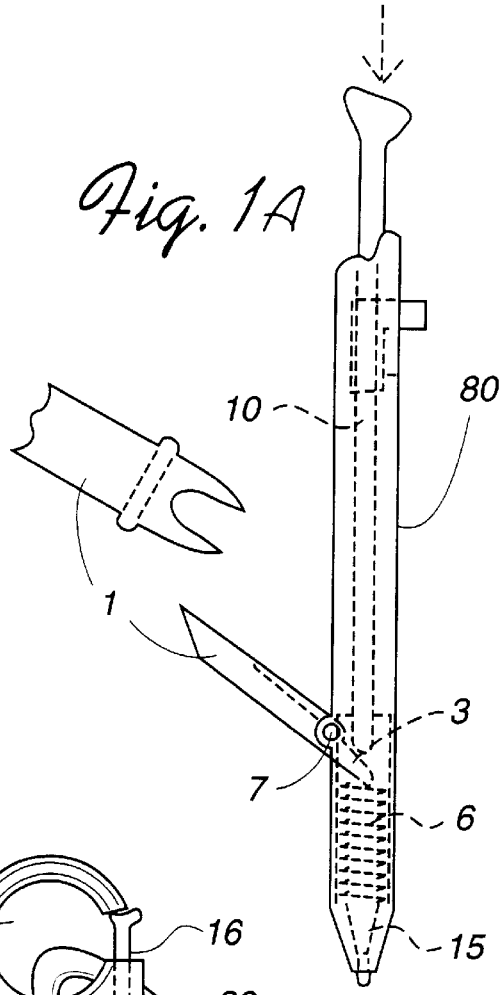
FIG. 1A is an elevational close-up-view of the securing mechanism(1), namely the pushrod and the swivel latch; and a close-up view exposing its inner parts of the pushrod which accommodate key ring and ball points at the bottom segment.

Referring to FIG. 1, the key holder with belt attachment comprises a main body 4, a key ring aperture 2, a compression spring 6, a protruding member 17, and a swivel latch. when the protruding member 17 is pulled downwards, the compression spring 6 is compressed, thereby pushing the pushrod 10 in downward direction. Refering to FIG. 1A, the downward motion of the pushrod 10 rotates the swivel latch 1 in a clockwise direction, thereby opening the belt attachment slot 8 and allowing a belt holder to be inserted into or removed from the key holder. When the protruding member 17 is pulled downward and the compression spring 6 is compressed, the upper end of the pushrod 10, the upper segment 16, is also pulled downward, thus opening the key ring aperture 2 and allowing a key ring holder to be secured on or released from the key holder.

Figure 2:
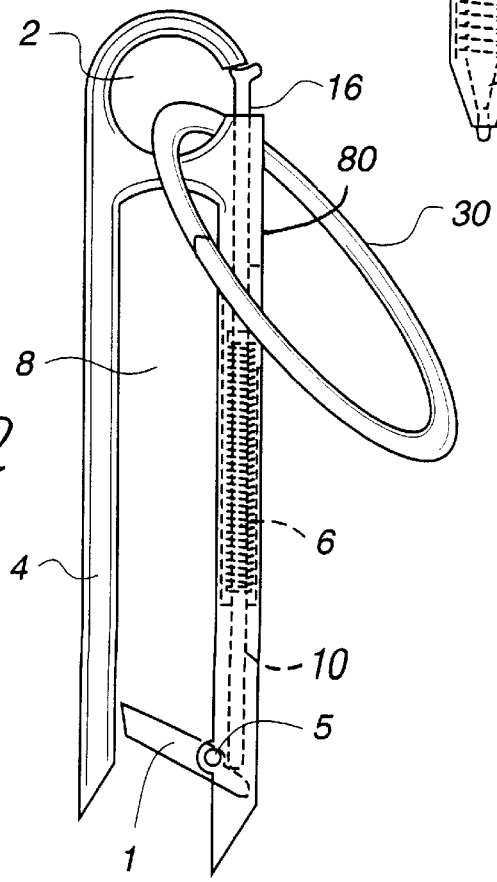
FIG. 2 is a right-side elevational close-up view of the key holder with belt attachment.

FIG. 2 depicts the present invention and the typical placement of a conventional key ring 30, the protruding member 16 is pulled downward.

FIG. 3 depicts variations of parts which open and close the swivel latch 1.

Figure 3A:
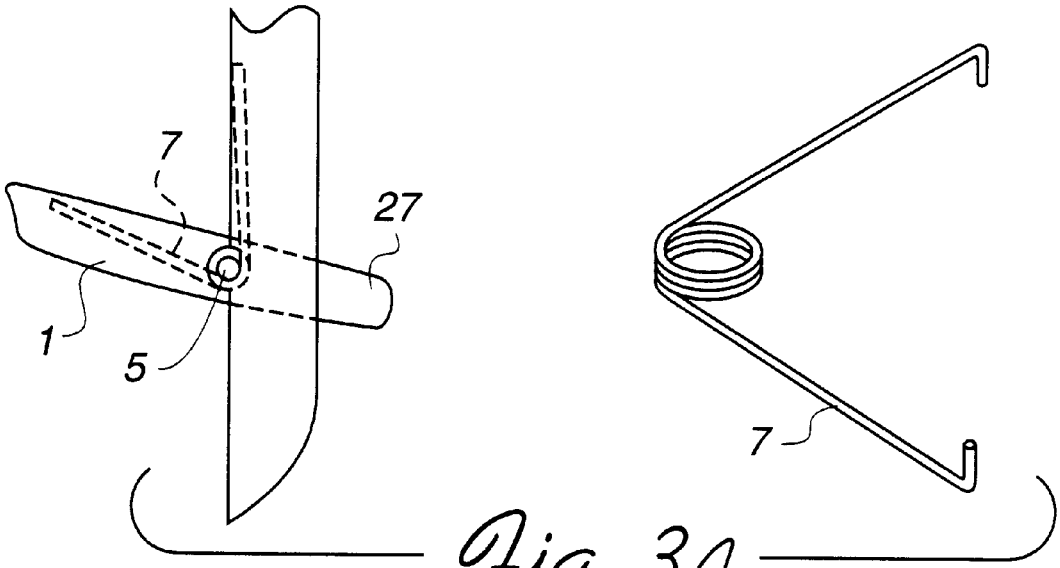
FIG. 3A depicts a variation of the swivel latch.

FIG. 3A depicts a variation of the swivel latch 1. This variation utilizes a jaw spring 7 to keep one side of the swivel latch 7 in the closed position. When the double ended swivel latch 7 is opened and released, the jaw spring causes said double ended swivel latch to close, thereby securing a belt in place.

Figure 3B:
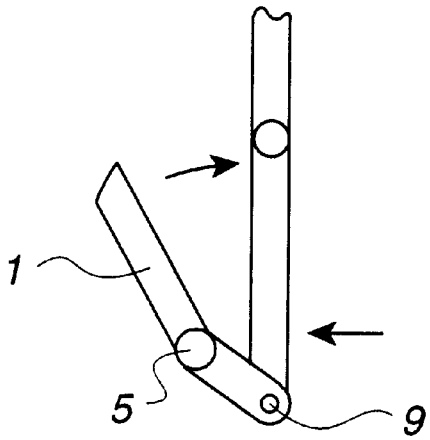
FIG. 3B depicts another variation of the swivel latch.

FIG. 3B depicts a variation of the swivel latch 1. This variation comprises several joints 5 and 9 which allow the swivel latch 1 to open and close, thus permitting a belt to be secured and removed from the key holder.

Figure 3C:
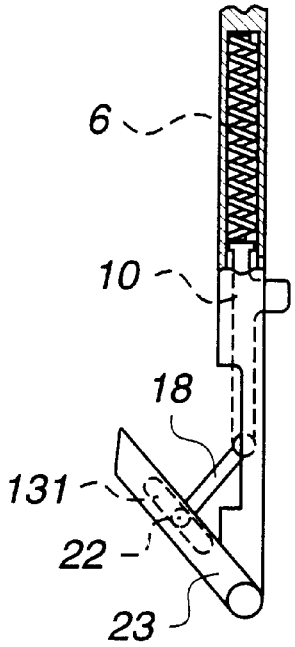
FIG. 3C depicts another variation of the swivel latch.

FIG. 3C depicts a variation the swivel latch 1. This variation comprises a swivel latch with an elongated aperture 14, wherein the elongated aperture 14 accommodates a sliding bracket 22. one end of the sliding bracket 22 is rotatably connected to the bottom end of the pushrod 10, and the opposite end to the sliding bracket 22 fits into the elongated aperture 14. When the compression spring is compressed, the pushrod 10 is pushed in a downward direction. This movement causes the sliding bracket 22 to rotate clockwise, thereby causing the swivel latch with an elongated aperture to open, allowing a belt to be inserted into the key holder.

Figure 3D:
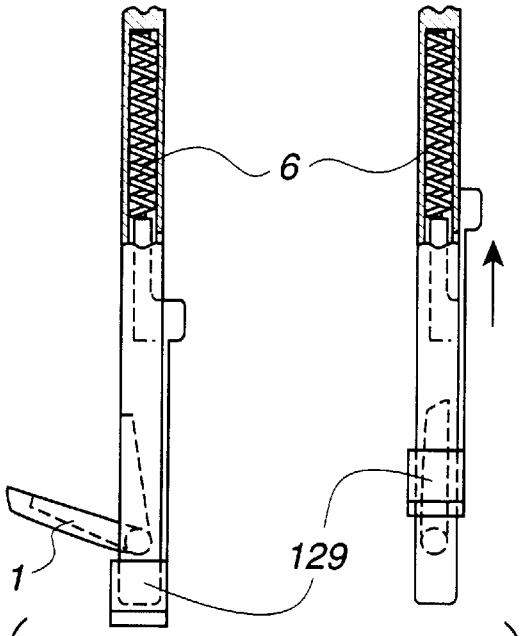
FIG. 3D depicts another variation of the swivel latch.

FIG. 3D depicts a variation of the swivel latch 1. This variation comprises a swivel latch 1 and bracket 26. When the bracket 26 is shifted upward, the swivel latch 1 is rotated in a clockwise direction, thus opening the belt slot 8 and providing a space for a belt.

Figure 3F:
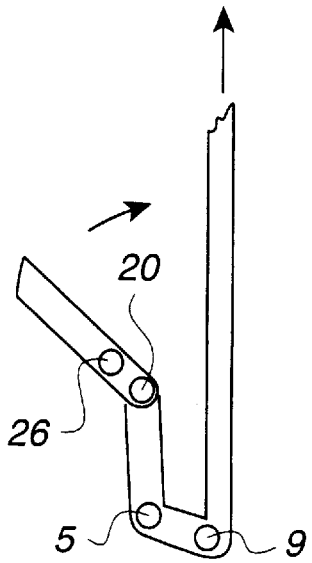
FIG. 3F depicts another variation of the swivel latch.
Figure 3E:
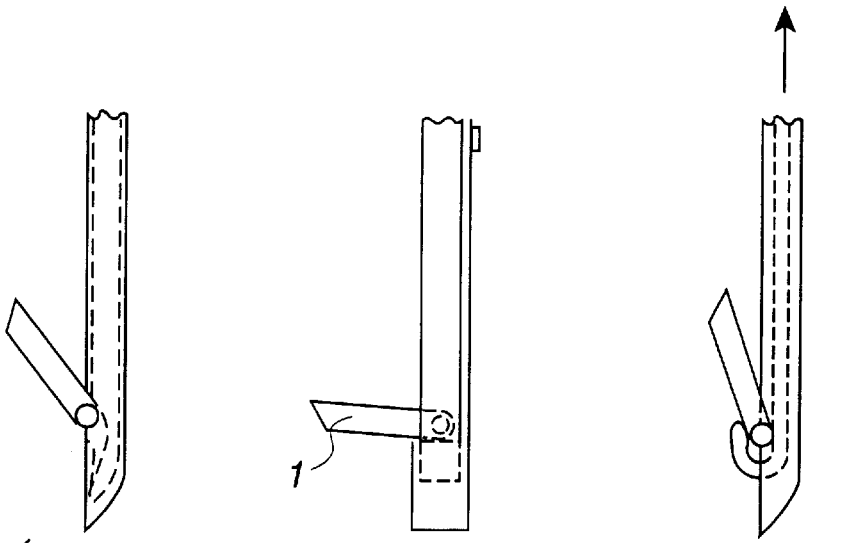
FIG. 3E depicts another variation of the swivel latch.

FIG. 3F depicts a variation of the swivel latch 1. This variation is similar to the variation disclosed in FIG. 3B, wherein instead of two joints 5 and 9, there are four joints 5, 9, 20 and 10.

FIG. 4 depicts a key holder with a different swivel latch 1 and a connecting rod. A belt 36 is inserted into the belt slot 8 by rotating the swivel latch 1. The swivel latch 1 is rotated by sliding up the bracket 26, thereby causing the swivel latch 1 is rotated into an open position. As with the key holder depicted in FIG. 1, when the protruding member 17 is pulled downward, the upper segment 16 is also pulled downward, thus opening the key ring aperture 2.

Figure 4A:
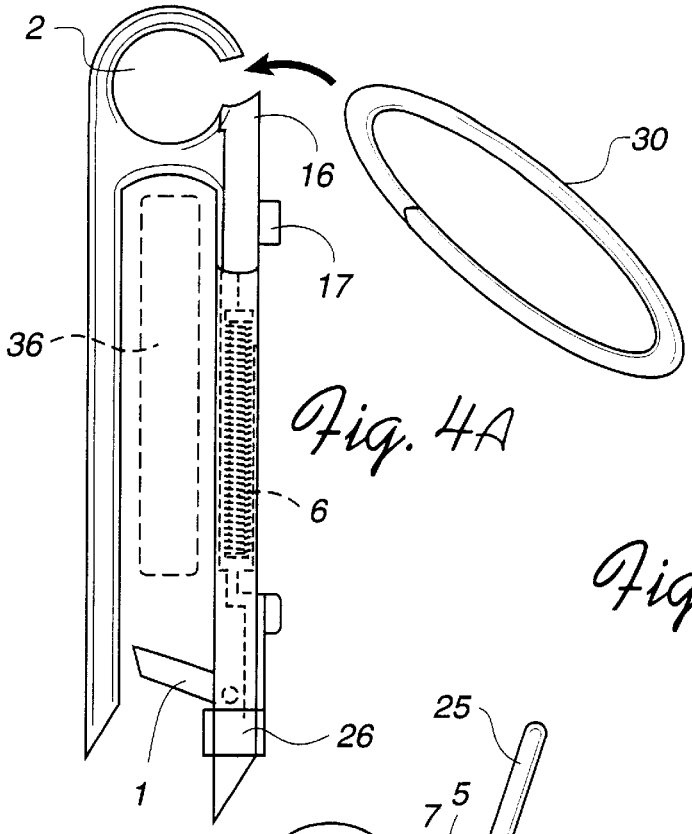
FIG. 4A is a right-side elevational close-up view of the key holder with the variation of swivel latch depicted in FIG. 3D.

FIG. 4A depicts to open the belt attachment swivel latch in wrapped position. Belt 36 fits into belt slot 8. swivel latch, rotates by sliding on bracket 26. As shown in FIG. 1, large portion of moving pin 16 is pulled down when protruding member 17 is pushed down, enabling key ring 2 to open.

Figure 4B:
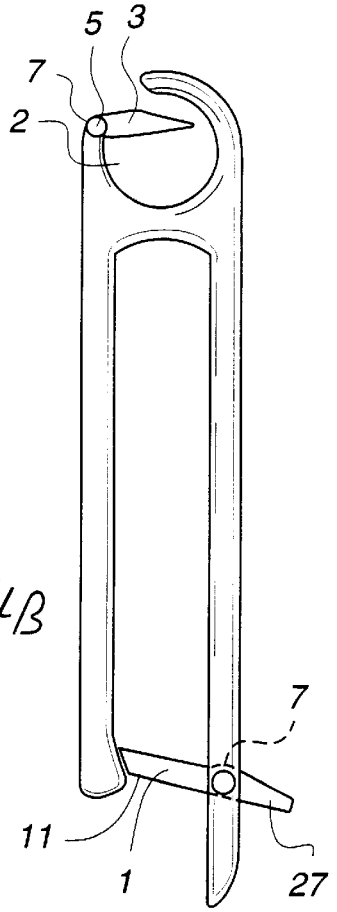
FIG. 4B is a right-side elevational view of new key holder with the securing mechanism affixed to a key.

FIG. 4B depicts a key holder attached in upper segment.

Figure 4D:
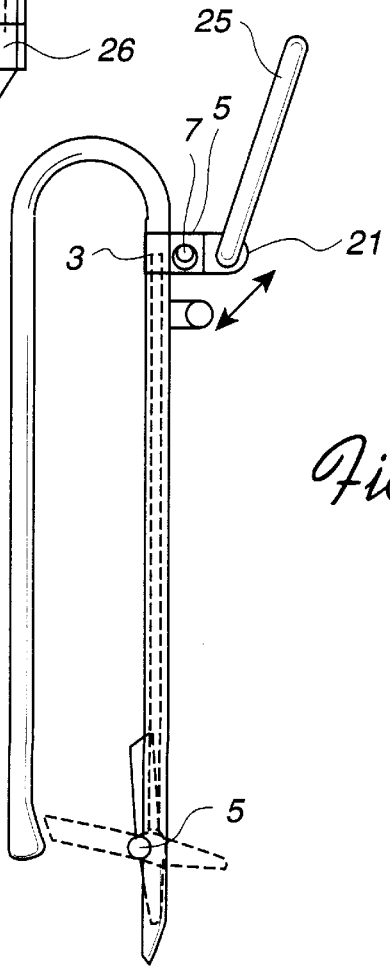
FIG. 4C is a key ring which can be a belt attachment and accommodate other key ring as depicted in FIG. 4D.
Figure 4C:
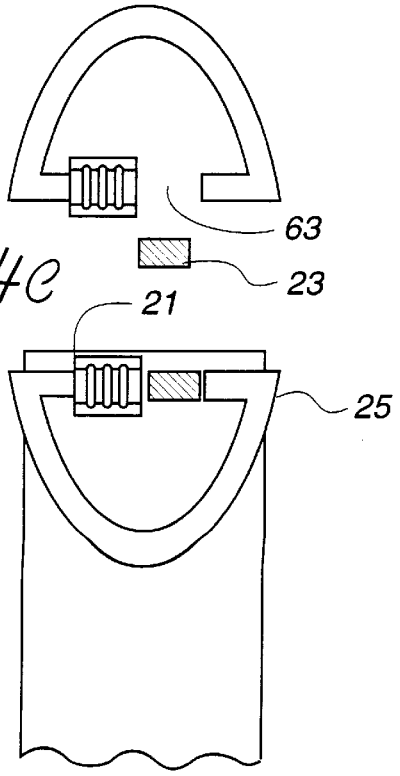

FIG. 4D depicts that when a key holder is pulled upward, lever is moved, and bar is opened in clockwise direction, thereby causing the key holder open as depicted FIG. 4C. A jaw spring 7 locates in FIG. 5 area.

Figure 5:
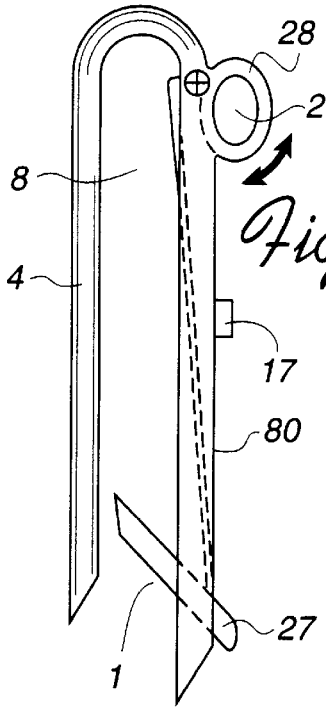
FIG. 5 & 5A depict a key holder attachment on belt with a key ring loop in upper segments.

FIG. 5 depicts a variation of the key holder. This key holder utilizes the jaw spring 7 as depicted in FIG. 3A. When the pushbar 27 of the swivel latch 1 is depressed, the swivel latch 1 rotates in a clockwise direction, thereby opening the belt slot 8. Also attached is a conventional key ring 28 in upper segment.

Figure 5A:
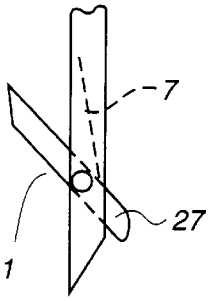

FIG. 5A is a detailed drawing of the jaw spring 7 and the swivel latch 1.

Figure 6:
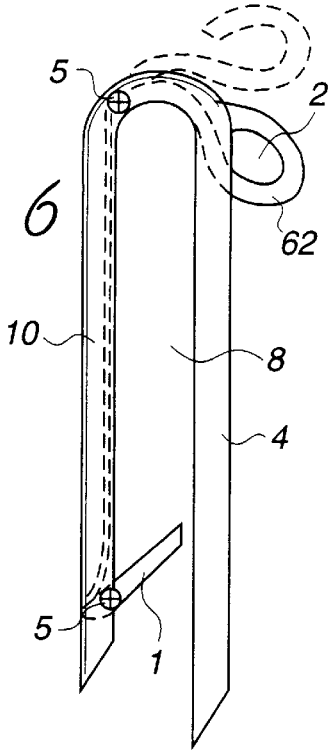
FIG. 6 is a right-side elevational view of the key holder with another variation of the securing mechanism.

FIG. 6 depicts a variation of the key holder. This key holder comprises a key ring 62 which is attached to a pushrod 10. At the junction where the key ring 62 and pushrod 10 meet, there is a joint which allows the key ring 62 to rotate counterclockwise. Because the pushrod 10 is connected to the key ring 62, when the key ring 62 is rotated in a counterclockwise direction, the pushrod 10 is also rotated in a counterclockwise direction, pressing against the end of the swivel latch 1. This rotates the swivel latch in a counterclockwise direction and opens the belt slot 8.

Figure 7:
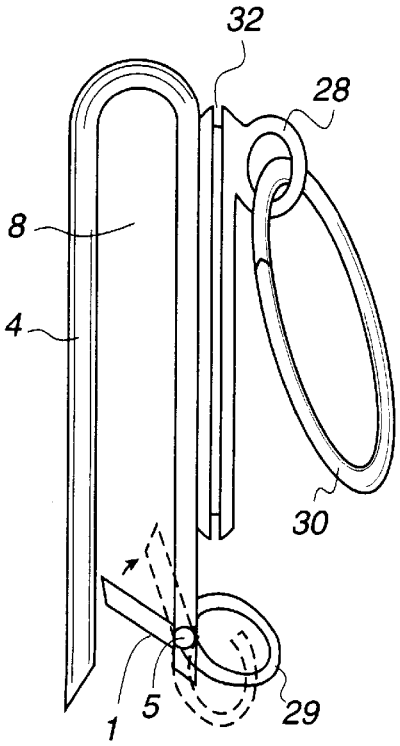
FIG. 7 is a right-side elevational view of the key holder with another variation of the securing mechanism.

FIG. 7 depicts a variation of the key holder. This key holder comprises a knife 40 a rotating key ring 29 milled in a knife and a swivel latch 1 in a main body. The rotating key ring 29 is attached to the swivel latch 1 and operated by a jaw spring 7. When the rotating key ring 29 is depressed a clockwise direction via a hinge 31 between the rotating key ring and the swivel latch 1, the swivel latch 1 is also rotated in a clockwise direction. This enables a belt to be inserted into the belt slot 8.

Figure 8:
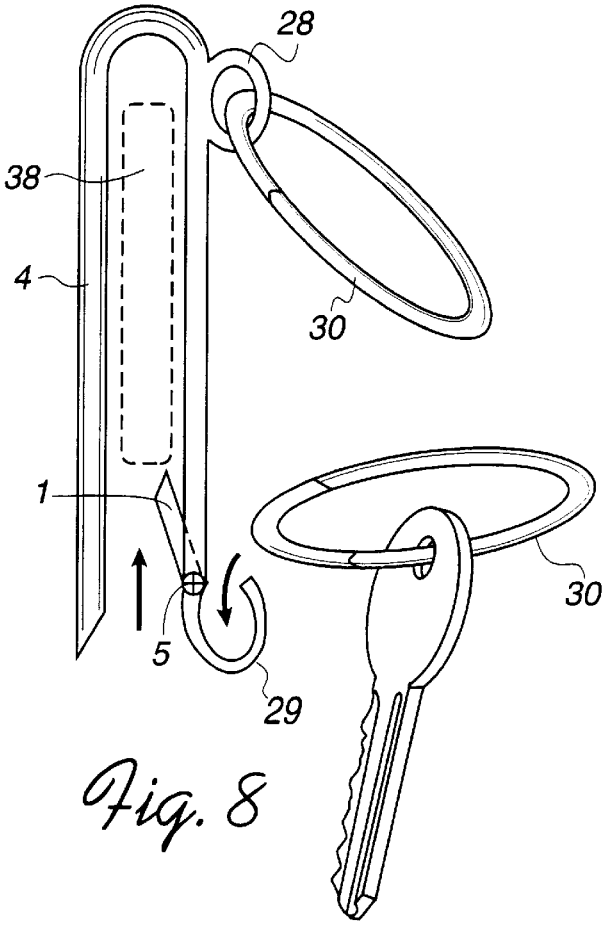
FIG. 8 is an opened view of swivel latch in FIG. 7.

FIG. 8 depicts the key ring disclosed in FIG. 7 with the rotating key ring 29 rotated and the swivel latch in the open position; the knife 40 is not included in this embodiment.

Figure 9:
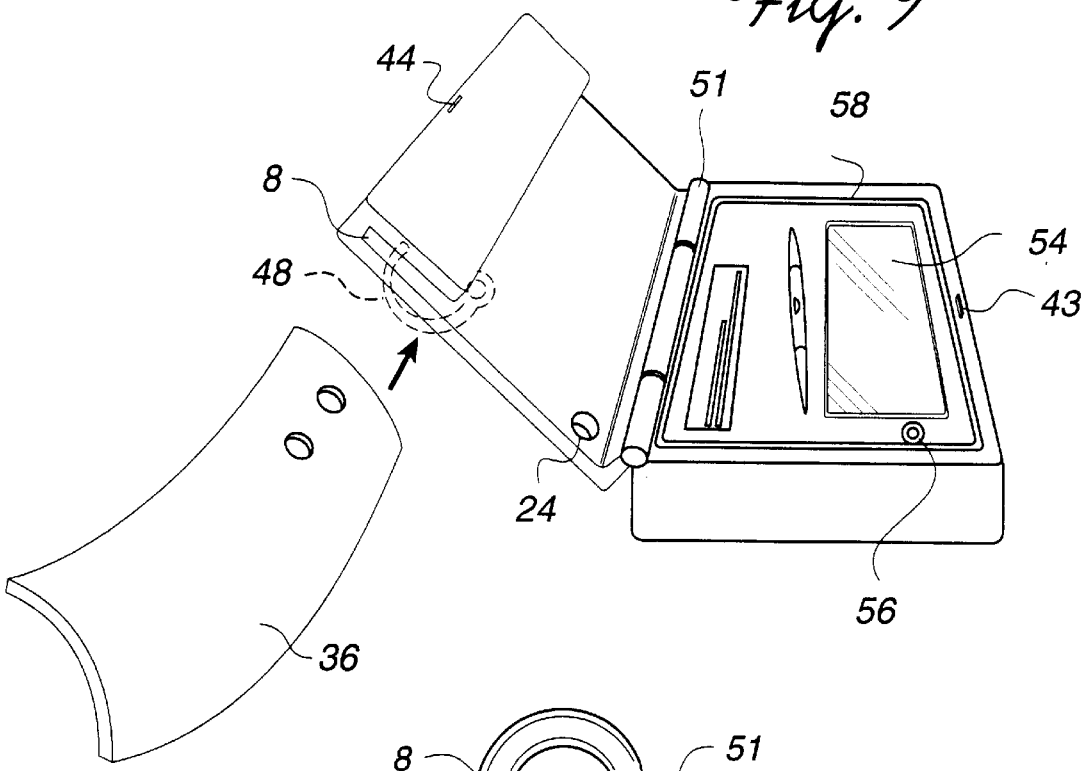
FIG. 9 is a perspective view of the belt attachment opened laterally, wherein the pager case is secured.

FIG. 9 depicts a key holder which also accommodates a pager. The key holder comprises a belt attachment 74, a pager holder 58, and a key ring 48. The belt attachment has a slot which allows the key holder to hang from a conventional belt 36. At the bottom of the belt attachment 74 with the pager 58. The belt attachment 74 and the pager holder 58 have fastening means 44 and 43, respectively, which allow the pager holder to swivel upwards and lock in place, thus concealing and protecting the pager 58, A key ring 48 is provided to accommodate keys and other items.

Figure 10:
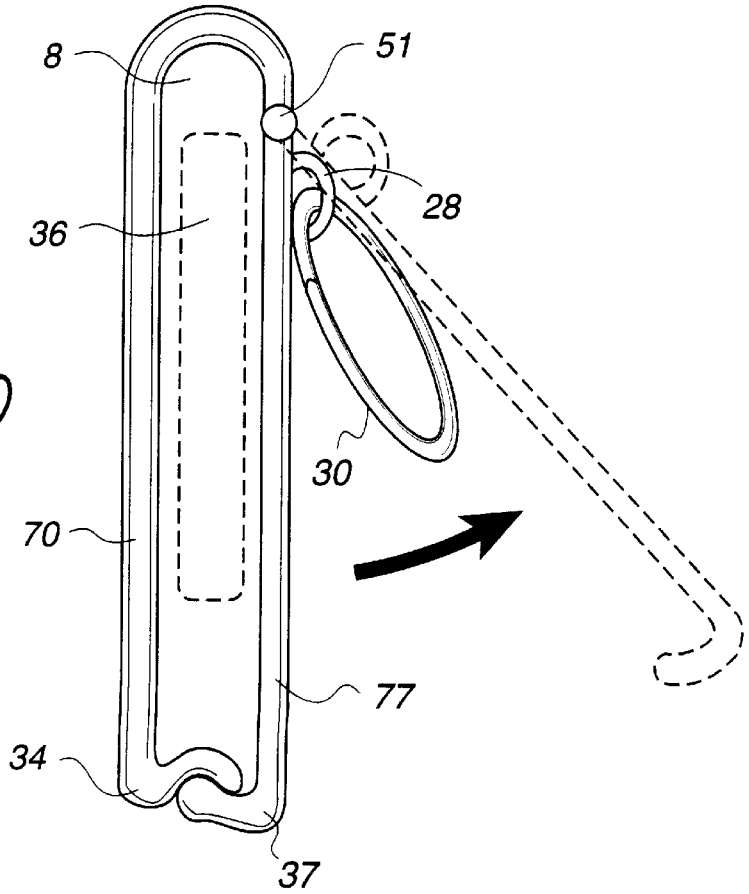
FIG. 10 is a key holder for belt attachment of FIG. 9 which can be operated by function of hinge 5.

FIG. 10 depicts a variation of the key holder. This variation comprises an inner member 34 and an outer member 35 which are rotatably connected at a hinge 51 which allows the key holder to be hung on a belt, with the inner member 34 positioned on the inside of the belt 36 and the outer member 35 positioned on the outside of the belt 36. The curved end 34 of the inner member 70 and the curved end 37 of the outer member 35 correspond and interlock with each other, securing the key holder in place.

Figure 11A:
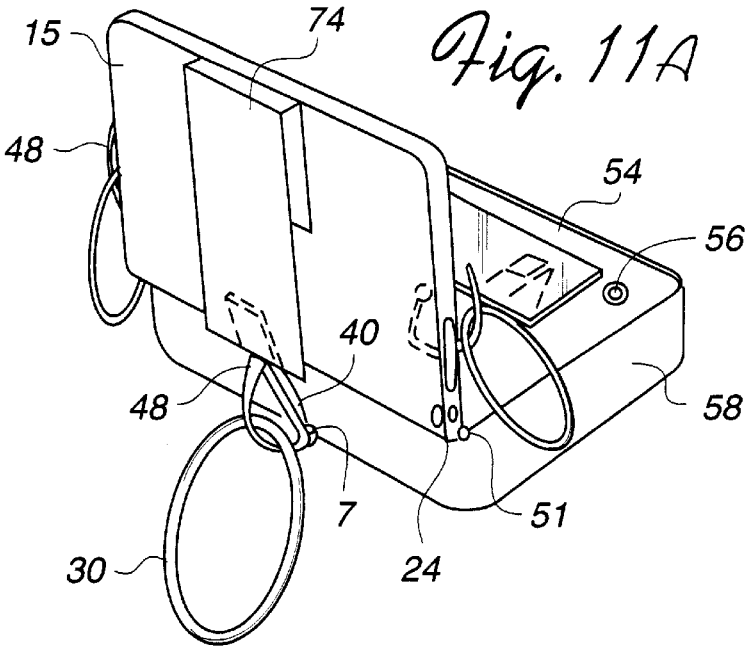
FIG. 11A is a perspective view of a key holder for the belt attachment, wherein the pager case is secured.

FIG. 11 depicts a key holder that also accommodates a pager. It is a rear perspective view of the key holder. The pager holder 58 and the belt attachment 74 are connected by a hinge 51 which allows the pager holder 58 to swivel upwards and downwards. The key holder also has key rings 48 which accommodate for keys or other key rings. On the backside of the belt attachment is a belt clip 74 which allows the key holder to be worn. A key ring hinge mechanism 48 secures the belt clip 74 in place. In addition, key rings 30 can be attached to a loop 46 provided by the key ring hinge mechanism 48. The key ring hinge mechanism utilizes a jaw spring 7 to clamp the belt clip 74 shut, thereby securing it in place.

Figure 11C:
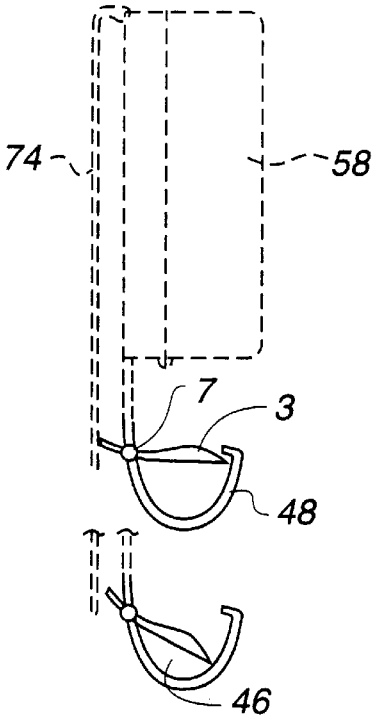
FIG. 11C is a right-side perspective view of the same key holder depicted in FIG. 11A.
Figure 11B:
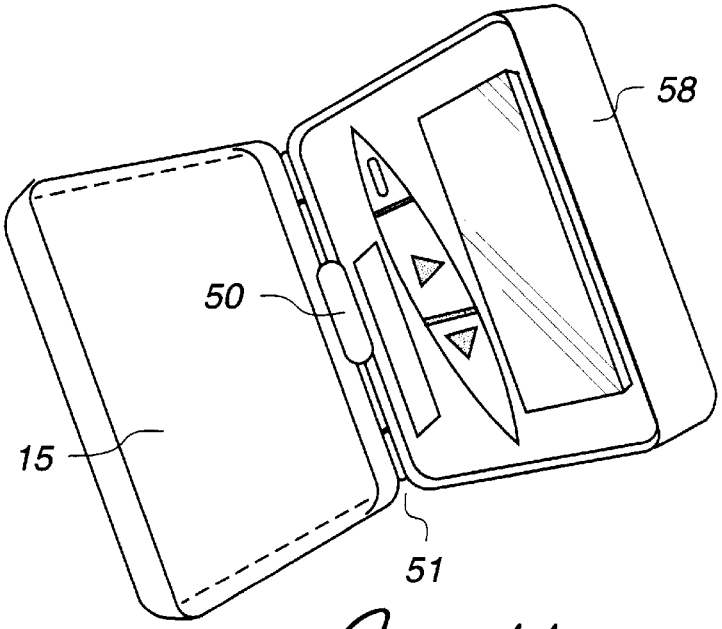
FIG. 11B is an inner view of a pager case, hinge, and a compression spring.

FIG. 11B connected at the hinge 51 of the key holder, depicts a motion impeder, compression spring 50 which prevents the pager holder 58 from rotating a full 90 degrees with respect to the belt attachment 15, resulting the pager holder in its original position. This provides convenient pager viewing from eyes. When it is dark, the switch 56 is automatically lighted.

FIG. 11C depicts the key holder and pager 58, exposing the key ring hinge mechanism 48.

Figure 12:
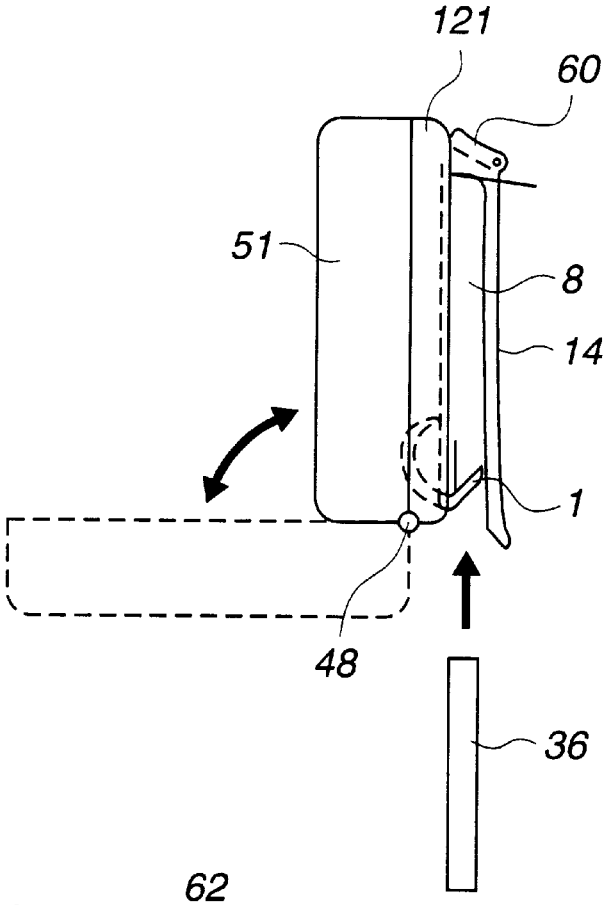
FIG. 12 is a perspective view for a pager case affixed to a belt attachment and opened in a rectangular manner by a spring of pushrod and the opening of the belt swivel latch in upper segment.

FIG. 12 depicts a pager holder. This key holder comprises a main body 69, belt clip 4, swivel latch 1, and pager case 58. The pager case is rotatably connected to the main body 69, which is attached to the belt clip 4. The swivel latch 1 utilizes a jaw spring 7 to secure a belt 36 is the belt slot 8 when the belt 36 is inserted.

Figure 13A:
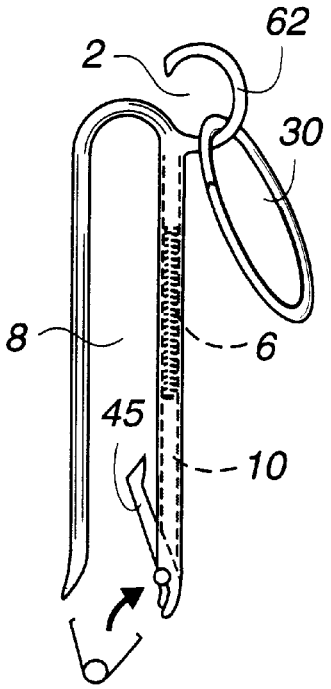
FIG. 13A is a right-side elevational view of the key holder with a new variation of the key fastening and securing, and the swivel latch fastening, securing mechanism.
Figure 13B:
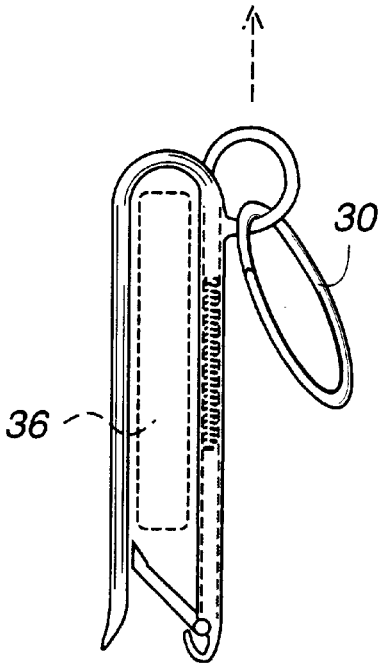
FIG. 13B is a right-side elevational view of the key holder depicted in FIG. 13A, wherein the belt slot and key ring are closed, and the belt swivel latch is also closed.

FIG. 13A depicts a variation of key holder. The compression spring 6 is connected to a pushrod 10, which is connected to a key ring 62. When the key ring is pulled upward, the key ring aperture 2 is opened, allowing keys or another key ring to be secured onto the key ring 62. When the key ring is released, the compression spring 6 pulls the pushrod 10 downward, which also pulls the key ring 62 downward, thereby closing the key ring aperture 2, as depicted in FIG. 13. The swivel latch 45 is operated by a jaw spring 7. When a belt 36 is inserted into the belt slot 8, the swivel latch closes, thereby securing the belt 36 in place, as depicted in FIG. 13B.

FIG. 14A depicts a key holder attached to can opener 37. The key ring 61 on the key holder comprises a compression spring and the fastening mechanism 21. The ring 61 is not a complete ring; a segment of the ring 6 is replaced by the fastening mechanism 21. When the fastening mechanism 21 is released, the spring causes the fastening mechanism 21 to return to its original position, thereby securing the key in place.

FIG. 14B depicts the key ring 61.

FIG. 15A depicts a key holder attached to a pocket knife 66. The other type of key ring 61 used in the key holder in FIG. 14A. is also used for this key holder.

FIG. 15B, FIG. 15C, and FIG. 15D are other variations of this key ring.

Figure 16:
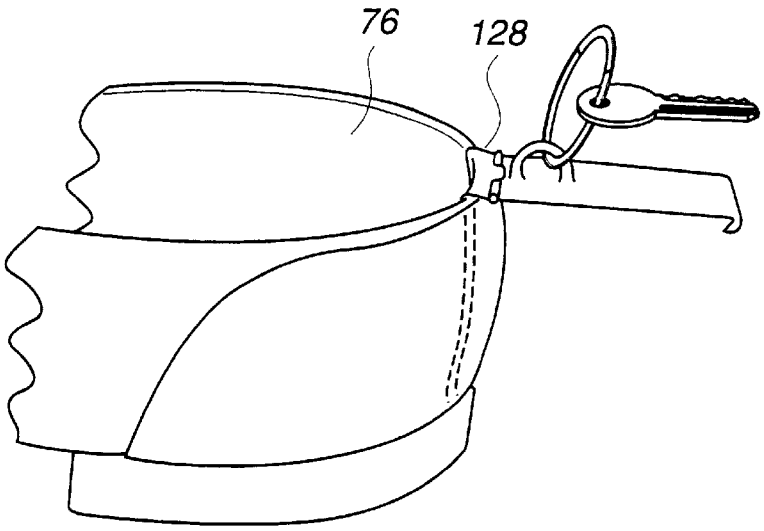
FIG. 16 is a right-side elevational view of a key holder, wherein one side can be a shoe-horn and can be fastened on flexible belt in 90 degree angle.

FIG. 16 depicts a variation of the key holder as depicted in FIG. 10 as worn on a conventional shoe. This key holder is to be worn comfortably on the heel portion of a conventional shoe.

Figure 24:
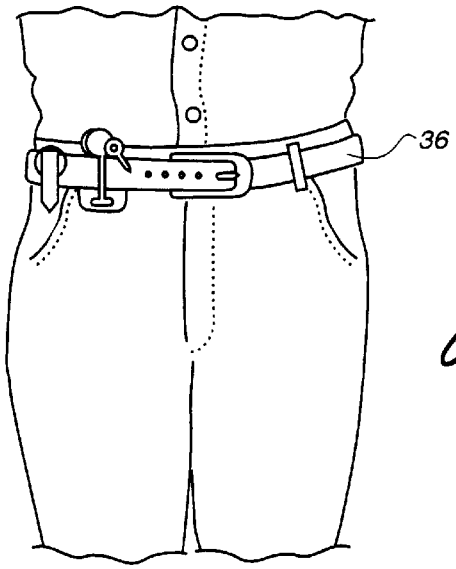
FIG. 24 is a view of writing utensil of FIG. 23 secured in belt and a key ring shaped as shoe horn of FIG. 15 secured in pants.

FIG. 15A, FIG. 16 depicts a key holder as shoe-horn shaped can be easily worn on pants of FIG. 24 or skirts.

Figure 17:
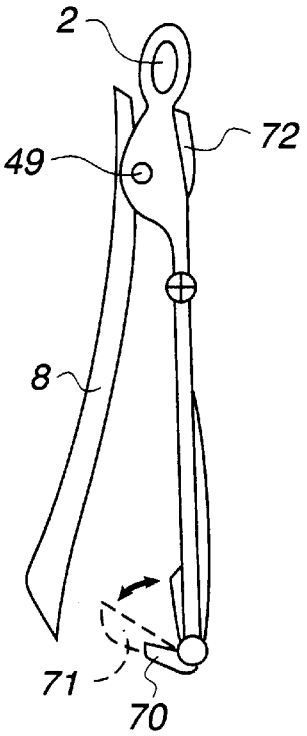
FIG. 17 depicts a dual locking mechanism which one side has a key ring loop in upper segment and other side accommodate a pager, a shoe horn and other articles.

FIG. 17 depicts a variation of the belt clip for the pager holder depicted in FIG. 12, a key holder in upper segment and a shoe-horn key holder. This variation of belt clip utilizes a jaw spring 7 at a joint 5 which allows the clip to be opened when the protruding member 72 is depressed. Between two fastening brackets, bracket 71 swings in, locking the belt 36 in its original position.

Figure 18:
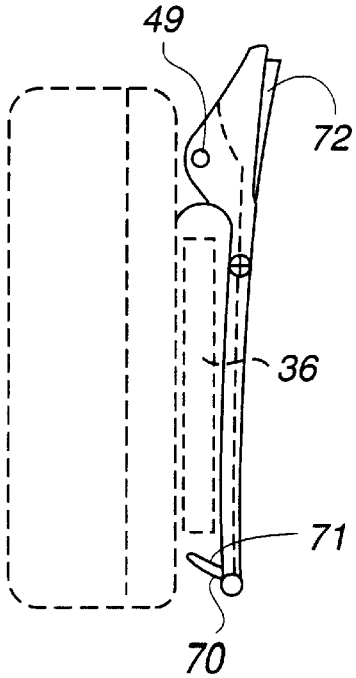
FIG. 18 is a dual belt fastening mechanism attached to a pager, a hand phone, walkman and case for glasses, etc.

FIG. 18 depicts variation of belt clip depicted in FIG. 17 used in conjunction with the pager holder as like FIG. 12.

Figure 19:
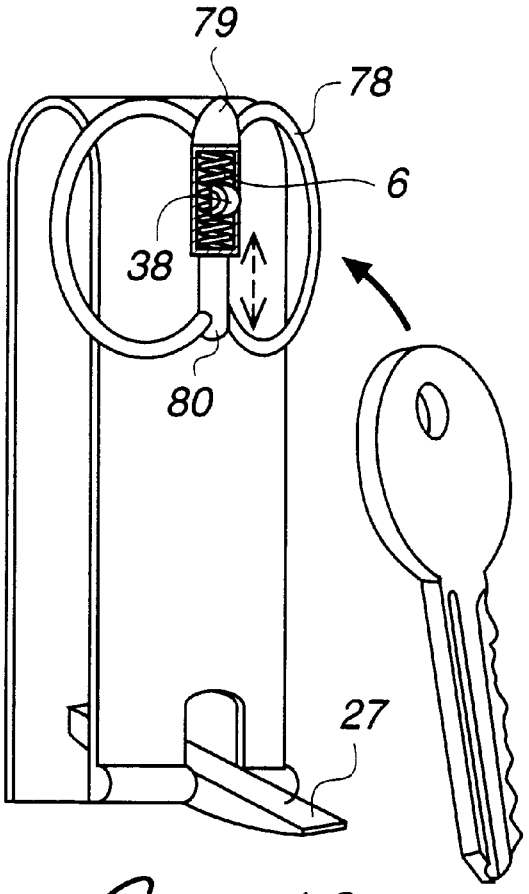
FIG. 19 is a lateral view of the belt attachment which accommodate a key or a key ring in upper segment and accommodate a key ring with a manual belt swivel latch.
Figure 20:
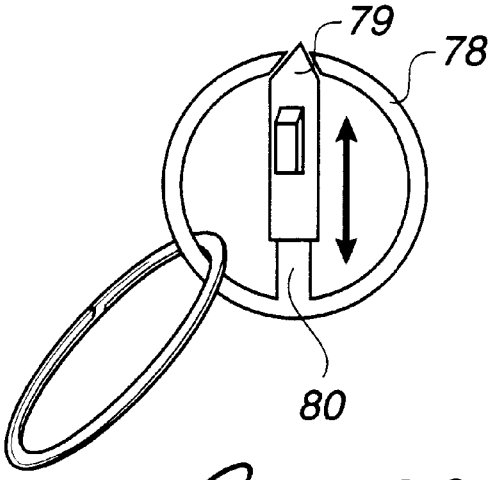
FIG. 20 is a sample used only as a key ring function separate from FIG. 19.

FIG. 19 depicts a new double-side key ring which comprises a key ring 33, a key ring main body 39, a fastening member 21, a compression spring 6, and a protruding member 38. The key ring main body 39 is attached on the main body of belt attachment or the spring cover 3 is attached on a main body. Instead, a fastening mechanism 21 attached to the key ring main body 39 by the compression spring 6 corresponds with a gap in the key ring 78, thereby yielding two separate rings, both of which can accommodate key and/or key rings. When the fastening mechanism is released, the compression spring 6 returns the fastening mechanism 21 to its original position, thereby securing the keys in place.

Figure 21A:
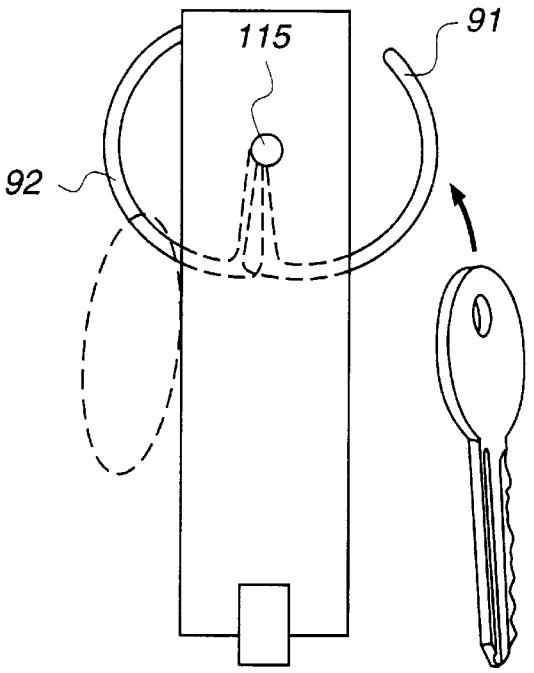
FIG. 21 is a front elevational view of the belt attachment with variation of the key holder mechanism.
FIG. 21B is a right-side lateral view of the key holder.

FIG. 21 is a key holder with a center of double sided key ring 73 and 33. A main joint 5 is attached the double sided key ring and onto key holder. The double sided key rings 73 and 33 can accommodate keys on both sides of the key rings 73 and 33. When one of the sides of the key ring 33 is pulled, a key and/or a key ring can fit through the aperture created and secured onto the key ring. When released, the key ring returns to its original position.

Figure 21B:
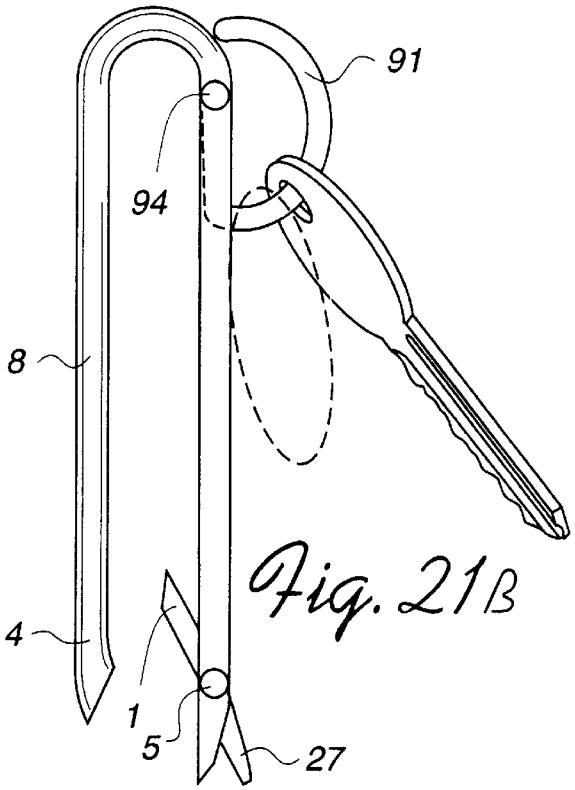

FIG. 21B is a key holder opening in a full 90 degrees from the direction of attached belt.

Figure 22:
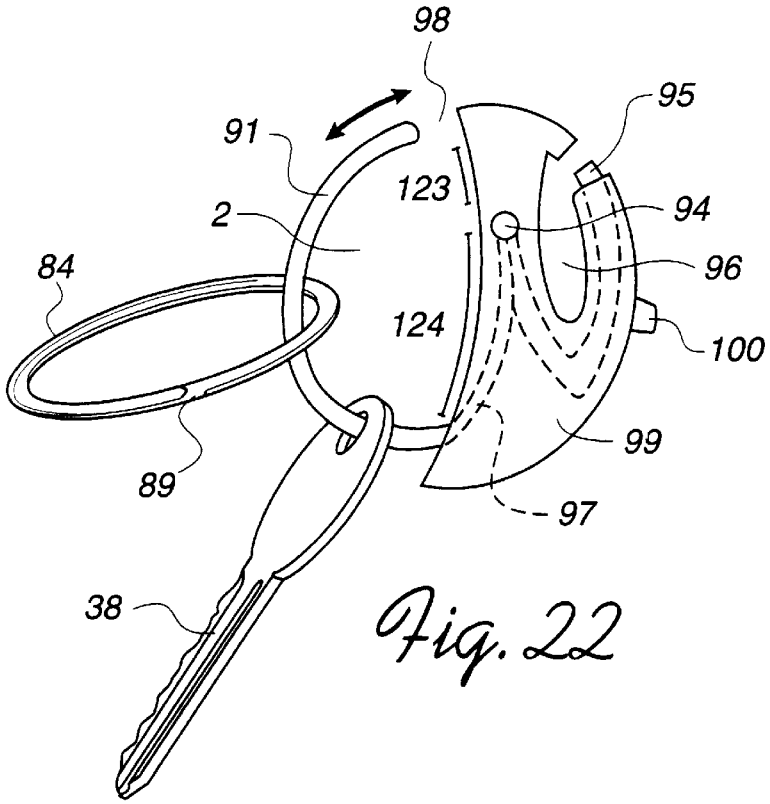
FIG. 22 depicts one and or dual locking mechanism of the key holder.

FIG. 22 is a key ring which can be used one or two key rings together.

Figure 23A:
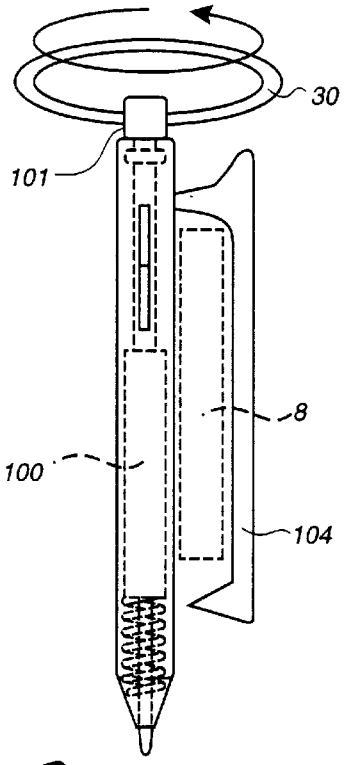
FIG. 23A is a right-side elevational view of a key holder affixed to a writing utensil.

FIG. 23 is a writing utensil 52 attached to a key ring 30. At the top of the writing utensil 52 is a 360 degrees rotatable head 52 with an aperture which accommodates a key ring 30. Along the side of the writing utensil 15, is a belt slot 8; a conventional belt can slide through this slot 8, thus securing the writing utensil in place.

Figure 23B:
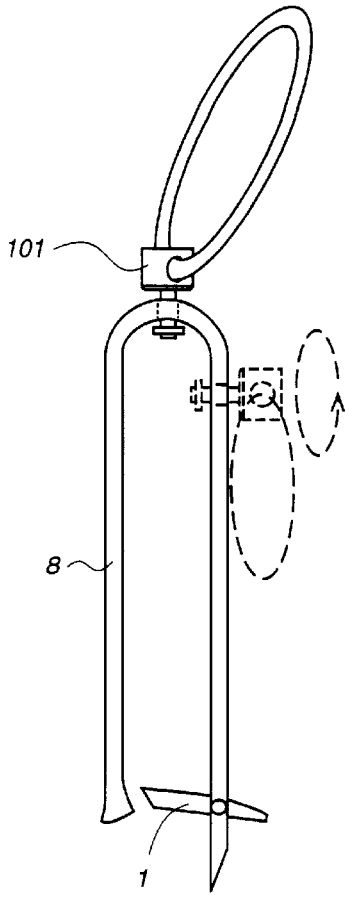
FIG. 23B is a belt attachment with a key ring rotatable 360 degrees.

FIG. 23B depicts a key holder which has a rotatable key ring holder in its upper or lateral segment.

Figure 25A:
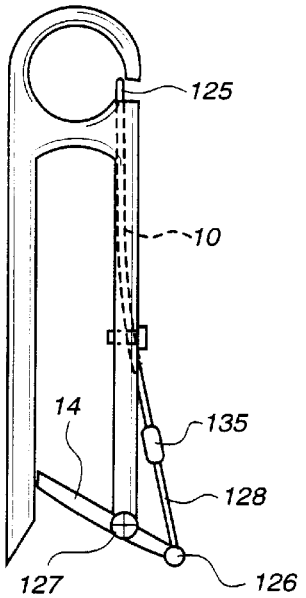
FIG. 25A is a swivel latch utilizes a compression spring.

FIG. 25A depicts a key holder with a new securing mechanism. The key holder comprises a key ring aperture entrance 63, a compression spring 65 a button 66, 65, a main strut 66, a main joint 5, and a swivel latch 1. When the button 65 is depressed, the main strut 66 is also depressed. This causes a rotating motion of the swivel latch about the fixed joint 5, thereby opening the key holder to accommodate a belt slot 8. When a compression spring area is depressed by the key ring, the compression spring is also depressed inward, thereby causing key entering into key ring aperture. Key is released by depressing a key ring aperture member.

FIG. 24 is a key holder depicted in FIG. 23 and also a key holder secured on conventional belt depicted in FIG. 15A.

Figure 25D:
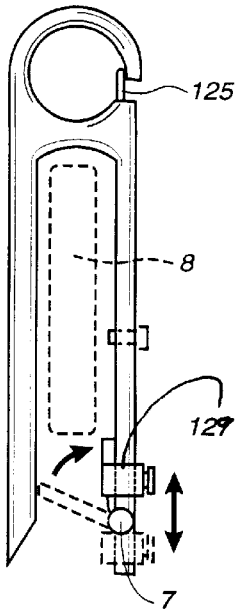
FIGS. 25E, F is a close-up view of the hinge depicted in FIG. 25A.
FIGS. 25B, C, D, is a right side elevational view of a key ring with variations of the key holder mechanism by a compression spring.
FIG. 25C is a view of the inward opening of the key ring and the outer case covering the ring again.
Figure 25B:
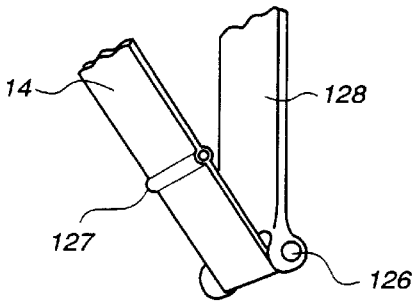

FIG. 25B is a belt swivel latch utilizes spring function, wherein utilizes a compression spring or plastic and a key holder with key loop in upper segment.

Figure 25E:
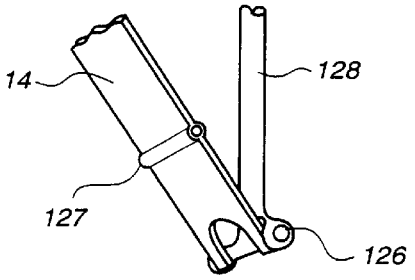
Figure 25C:
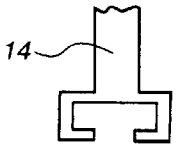
Figure 25F:
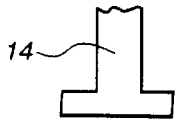

FIG. 25C depicts key ring attachment rotating left or right in upper segment.

FIG. 25D depicts a key holder with a shoe horn on one side and a key ring in upper and lateral segment.

FIG. 25E, F is variation of the main joint 66.

FIG. 25D depicts a key holder opening and closing in a full 90 degrees by a compression spring.

Figure 26A:
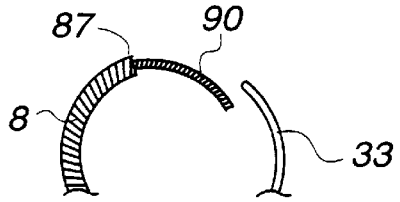
FIG. 26A is a view of the inward opening of the key ring and the outer case covering the ring again.
Figure 26B:
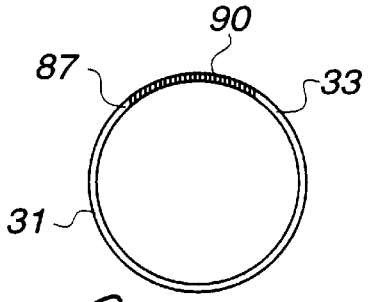
FIG. 26B is a view of closed both-ends of the severed key ring.
Figure 27A:
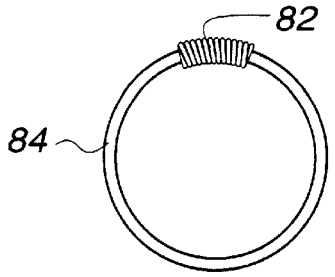
FIG. 27A is a closed view of the outer case covering ring again.
Figure 27B:
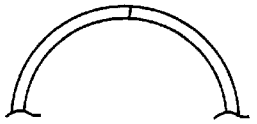
FIG. 27B is a key ring in closed position.

FIG. 26A depicts a new key ring 30 which has a novel opening mechanism. A section of the ring is removed, and in its place, there is a swiveling member which opens inward which allows opening for keys or key rings. On the other hand, one end 21, of which covered by compression spring 6, covers swiveling member as shown in FIG. 15 or 27A, 28A.

Figure 28A:
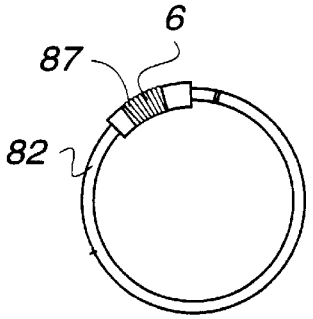
FIG. 28A is a dual locking of the joint segment of the swivel mechanism depicted in 28B, C.
Figure 27C:
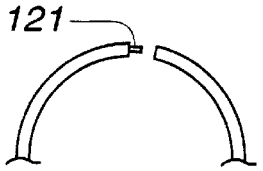
FIG. 27 is a key in opened position.
Figure 28B:
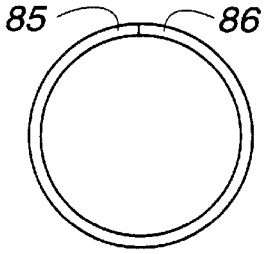
FIGS. 28B, C is a lateral view of the swivel ring mechanism in open position.
Figure 28C:
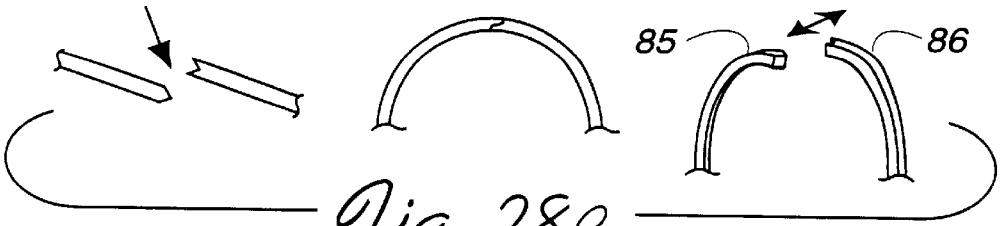

FIG. 27C, FIG. 28B, FIG. 28C depicts, when the severed ends of male component and female component are well joined, keys are well secured in the key ring.

FIG. 28A depicts a new key ring 89 which has a novel opening mechanism.

FIG. 28B depicts how severed rings are securely joined at a right angle or fit into the groove as shown in FIG. 28C.

FIG. 27A, 28A depicts the outer cover 21 operated by a compression spring that dually secures keys that are already in place by several mechanisms as explained above.

What is claimed as being new and therefore desired to be protected by Letter Patent of the United States is as follows:

1. A belt attachment device for holding keys and wearing on a belt, the belt attachment device comprising:

a body having first and second legs defining a slot for slidely engaging the belt;

a push rod extended through and slidably located in the second leg of the body, the push rod having first and second ends; and a latch pivotally connected to the second leg to pivot with respect to the second leg, the latch having a first portion and a second portion, wherein the first portion extends toward the first leg at an acute angle with respect to the second leg, and when the second end of the push rod abuts against the second portion of the latch, the first portion of the latch pivots toward the second leg to maintain an open position to allow the belt to slide into the slot.

2. The belt attachment device of claim 1, further including a protrusion projecting from the push rod through the second leg for moving the push rod along the direction of the length of the second leg to pivot the latch.

3. The belt attachment device of claim 1, further including a spring disposed in the second leg and in surrounding relation to the push rod, wherein the push rod is biased with the spring to dispose the first portion of the latch in a closed position with respect to the first leg to prevent the belt from sliding out of the slot.

4. The belt attachment device of claim 1, wherein the second portion of the latch extends opposite to the first portion and out of the second leg to allow manual pivoting of the latch.

5. The belt attachment device of claim 4, further including a spring disposed in the second leg and in surrounding relation to the push rod, wherein the push rod is biased with the spring to dispose the first portion of the latch in a closed position with respect to the first leg to prevent the belt from sliding out of the slot.

6. The belt attachment device of claim 1, further including a latch spring having a first segment and a second segment, wherein the first segment abuts against the latch and the second segment abuts against the second leg to bias the latch in a closed position to prevent the belt from sliding out of the belt attachment.

7. The belt attachment device of claim 6, further including a protrusion projecting from the push rod through the second leg for moving the push rod along the direction of the length of the second leg to pivot the latch.

8. The belt attachment device of claim 7, further including a spring disposed in a second leg and in surrounding relation to the push rod, wherein the push rod is biased with the spring to dispose the first portion of the latch in a closed position with respect to the first leg to prevent the belt from sliding out of the slot.

9. The belt attachment device of claim 8, wherein the push rod is biased with the spring to dispose the first portion of the latch in the closed position with respect to the first leg to prevent the belt from sliding out of the slot.

10. The belt attachment device of claim 6, wherein the second portion of the latch extends opposite of the first portion and out of the second leg to allow manual pivoting of the latch.

11. The belt attachment device of claim 1, the body further including a key retainer portion, wherein the first end of the push rod protrudes out of the second leg to abut against one end of the key retainer portion to define an enclosed loop to retain the keys.

12. The belt attachment device of claim 1, wherein the first end of the push rod extends out of the second leg of the body to form a key retainer, wherein when the push rod is slidably pulled away along the length of the second leg of the body, the key retainer portion is at an open position to receive the keys.

13. The belt attachment device of claim 12, wherein the second end of the push rod has a hooked portion to engage the latch in at least one of open and closed positions, wherein when the key retainer portion is at an open position, the hooked portion of the push rod clamps the latch in the closed position to allow the belt to be inserted into the slot of the body.

14. A belt attachment device for holding keys and wearing on a belt, the belt attachment device comprising:

a body having a U-shaped slot for sliding onto the belt, the slot defined by first and second legs, the body further having a key retainer portion;

a push rod slidably extending through the second leg of the body, the push rod having first and second ends, wherein the first end abuts against the key retainer portion to form an enclosed loop;

a spring located in the second leg and in surrounding relation to the push rod to bias the first end of the push rod to abut against the key retainer portion; and a latch pivotally connected to a lower end of the second leg to pivot with respect to the second leg to define at least one of open and closed positions, the latch having a first portion and a second portion, the first portion extending toward the first leg at an acute angle with respect to the second leg to prevent the belt from escaping from the slot.

15. The belt attachment device of claim 14, wherein when the second end of the push rod abuts against the second portion of the latch, the first portion of the latch pivots toward the second leg to maintain an open position to allow the belt to slide into the slot.

16. The belt attachment device of claim 15, further including a protrusion projecting from the push rod through the second leg for moving the push rod along the direction of the length of the second leg to pivot the latch.

17. The belt attachment device of claim 15, wherein the second portion of the latch extends opposite of the first portion and out of the second leg to allow manual pivoting of the latch.

18. A belt attachment device for holding keys and wearing on a belt, the belt attachment device comprising:

a body having a first and second legs defining a U-shaped slot for slidely engaging the belt;

a push rod extended through and slidably located in the second leg of the body, the push rod having first and second ends; and a latch pivotally connected to the push rod to pivot with respect to the push rod while moving along the length of the second leg, wherein when the push rod is pulled from the body, the latch is extended toward the first leg of the body to form an acute angle with respect to the second leg to prevent the belt from slipping, and when the push rod is pushed toward the body, the latch folds inside the second leg to allow the belt to be removed from the body.

19. The belt attachment device of claim 18, further including a spring disposed in the second leg and in surrounding relation to the push rod, wherein the push rod is biased with the spring to place the latch in an extended position toward the first leg of the body.

20. The belt attachment device of claim 19, further including a latch spring having a first segment and a second segment, wherein the first segment is arranged against the latch and the second segment is abutted against the second leg to bias the latch in the extended position.

* * * * *